US006039418A

United States Patent [19]

Thomas

[11] Patent Number: 6,039,418

[45] Date of Patent: Mar. 21, 2000

[54] FOLDING WARDROBE

[75] Inventor: Jackie K. Thomas, Vernon, Ala.

[73] Assignee: Omni International, Inc., Vernon, Ala.

[21] Appl. No.: 09/185,187

[22] Filed: Nov. 3, 1998

[51] Int. Cl.[7] ..... A47B 43/00

[52] U.S. Cl. ..... 312/258; 312/262; 312/400

[58] Field of Search ..... 312/258, 259, 312/262, 263, 257.1, 351.3, 400; 190/13 R, 14, 15 R, 15 A; 52/309.1, 309.4, 309.5, 309.15

[56] References Cited

U.S. PATENT DOCUMENTS

| | | | |
|---|---|---|---|
| 242,355 | 5/1881 | Nicholas . | |
| 680,206 | 8/1901 | La Mar | 312/262 |
| 835,902 | 11/1906 | Damato . | |
| 933,210 | 9/1909 | Ullom | 312/262 X |
| 1,015,430 | 1/1912 | Farmer | 312/258 X |
| 1,125,902 | 1/1915 | Downey et al. | 312/259 X |
| 1,342,269 | 6/1920 | Stewart . | |
| 1,576,284 | 3/1926 | Jones | 312/262 |
| 1,732,510 | 10/1929 | Gray . | |
| 2,299,766 | 10/1942 | Rosenthal . | |
| 2,341,899 | 2/1944 | Blechman . | |
| 2,403,469 | 7/1946 | Tucker | 312/400 X |
| 2,522,561 | 9/1950 | Blechman . | |
| 2,583,931 | 1/1952 | Cummings | 312/262 |
| 2,970,875 | 2/1961 | Derman | 312/262 |
| 3,195,968 | 7/1965 | Freeman | 312/351.3 X |
| 3,434,769 | 3/1969 | Salet | 312/258 |
| 3,797,905 | 3/1974 | Naske | 312/262 |
| 4,261,627 | 4/1981 | Felsenthal | 312/259 X |
| 4,579,401 | 4/1986 | Mears | 312/258 |
| 5,348,778 | 9/1994 | Knipp et al. | 312/400 X |

FOREIGN PATENT DOCUMENTS

| | | | |
|---|---|---|---|
| 687320 | 5/1964 | Canada | 312/259 |
| 381497 | 1/1908 | France | 312/258 |
| 1371349 | 7/1964 | France | 312/258 |
| 2239079 | 2/1975 | France | 312/258 |

*Primary Examiner*—Peter M. Cuomo
*Assistant Examiner*—James O. Hansen
*Attorney, Agent, or Firm*—Harness, Dickey & Pierce, P.L.C.

[57] ABSTRACT

A folding wardrobe having a bottom wall, top wall and left and right side walls which are each constructed of front and rear panels. The rear panels of each wall are fixed to a back panel and extend forwardly from a front face of a back panel. The front panels of each of the bottom, top and left and right side walls are hinged to the rear panels of each of the side walls so that the front panels of each of the walls can be folded to a stowed position overlying the back panel.

1 Claim, 5 Drawing Sheets

FOLDING WARDROBE

BACKGROUND AND SUMMARY OF THE INVENTION

The present invention relates to a folding wardrobe and in particular to a folding wardrobe in which the top, bottom, left and right sides are formed of two pieces so that the front most piece of each the bottom, top, left and right sides can fold over the back panel.

Numerous folding wardrobes have been developed. However, these typically suffer from problems of instability when used and not folding to the most compact configurations possible. A major difficulty in providing a wardrobe that will fold to a small, compact configuration is the order and arrangement in which the various walls of the wardrobe are folded. If all of the walls are coupled to a single panel such as the back panel, it is difficult to fold the top, bottom and the sides onto the back panel in a compact nature.

Accordingly, it is an object of the present invention to provide a folding wardrobe that folds into a compact configuration and which is stable in its unfolded use position.

The wardrobe of the present invention accomplishes the above objective by providing a bottom wall, a top wall and left and right side walls which are each constructed of front and rear panels. The rear panels of each wall are fixed to the back panel and extend forward from a front face of the back panel. The front panels of each of the bottom, top and left and right side walls are hinged to the rear panels of each of the walls so that when the front panels of each of the walls are folded to positions overlying the back panel they are disposed in planes forward of the back panel.

In addition, the rear panels of the bottom and top walls extend from the back panel further than the rear panels of the left and right side walls. This enables the front panels of the bottom and top walls to overlay the front panels of the side walls when in their stored positions.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
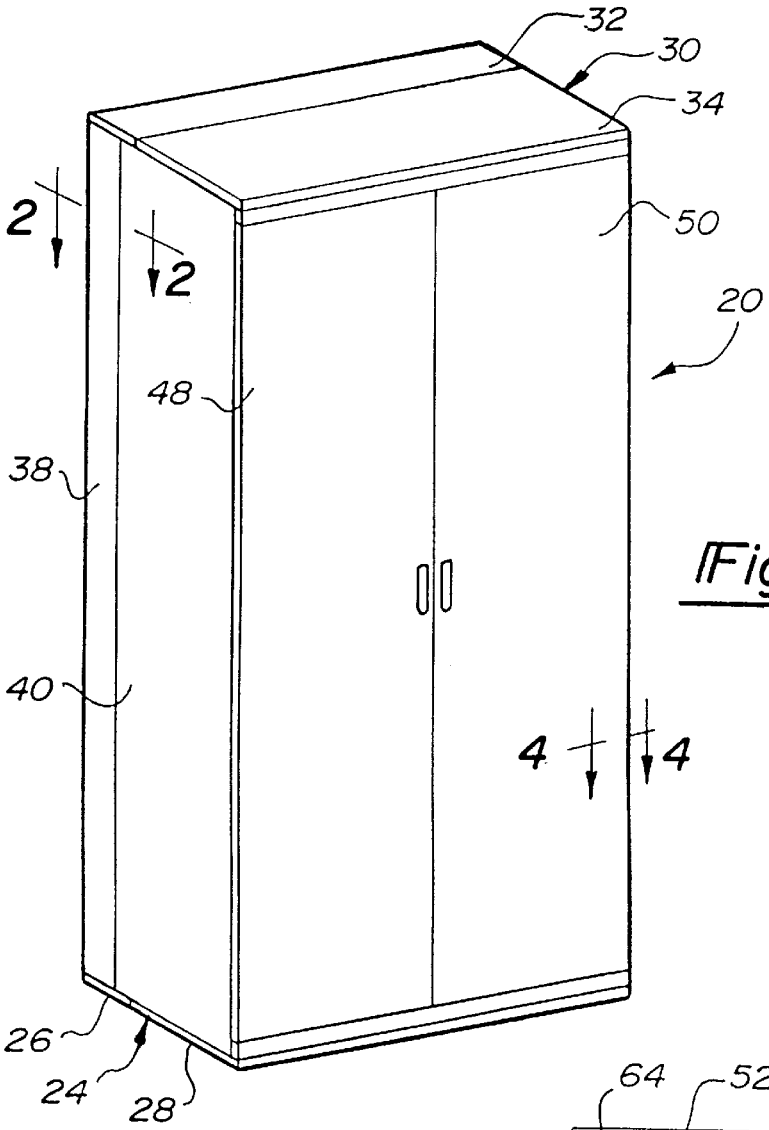
FIG. 1 is a perspective view of the folding wardrobe of the present invention in an unfolded upright use position.

The folding wardrobe of the present invention is shown in FIG. 1 and designated generally at 20. In FIG. 1, the wardrobe 20 is shown in an unfolded, use position. The folding wardrobe includes a back panel 22 to which all of the other components of the wardrobe are attached. The back panel further includes a bottom wall 24 comprised of a rear bottom panel 26 and a front bottom panel 28.

A top wall 30 is constructed of a rear top panel 32 and a front top panel 34. A left side wall 36 is constructed of a rear left side panel 38 and a front left side panel 40. Likewise, the right side wall 42 is constructed of a rear right side panel 44 and a front right side panel 46. The wardrobe is closed by left and right doors 48 and 50 respectively.

Figure 2:
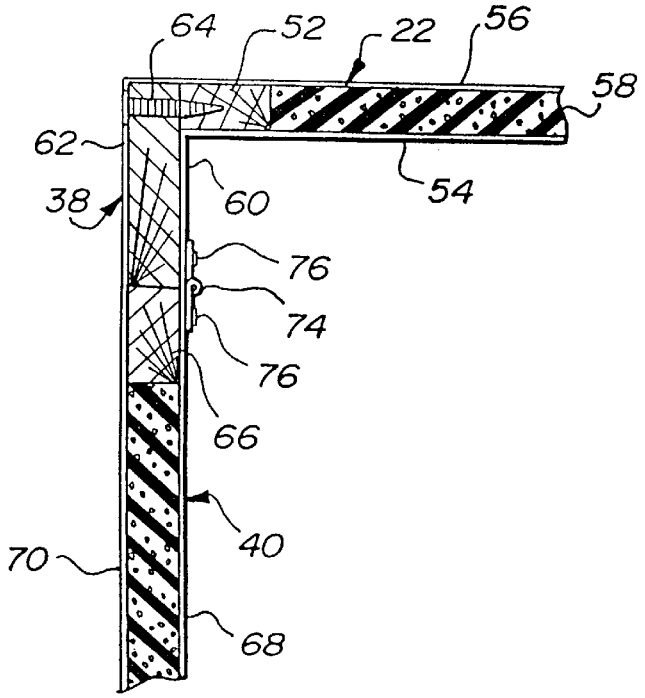
FIG. 2 is a sectional view of the wardrobe as seen from substantially the line 2—2 in FIG. 1.

With reference to FIG. 2, the construction of the wardrobe is shown in greater detail. The back panel 22 is constructed of a wood frame 52, a front cover and a rear cover 54, 56 formed by a decorative layer or film material, such as a laminate material and a light weight filler 58, such as a rigid foam within the frame 52 and decorative covers 54, 56. The rear left side panel 38 is of a solid wood construction having decorative covers 60, 62. The panel 38 is fixed to the back panel 22 by screws 64 or other metal fasteners. The front left side panel 40 is constructed similar to the back panel 22 and has a wood frame 66, interior and exterior decorative covers 68, 70 and a light weight filler 72. The front left side panel 40 is coupled to the rear left side panel 30 by a piano hinge 74 on the interior side of the left side wall. The piano hinge is attached by screws 76 into the solid panel 38 and into the wood frame 66 of the panel 40.

The rear bottom panel 26, rear top panel 32 and rear right side panel 44 are all of solid wood construction like the rear left side panel 38 shown in FIG. 2. The front bottom panel 28, front top panel 34 and front right side panel 36 are all constructed as light weight panels having a wood frame and light weight filler like the front left side panel 40. The doors 48, 50 are also constructed as light weight panels having a wood frame and filler core.

The rear bottom panel 26, rear top panel 32 and rear right side panel 44 are all fixed to the back panel 22 in the same manner as the panel 38 shown in FIG. 2. Likewise, the front bottom panel 28, front top panel 34 and front right side panel 46 are all attached to the respective rear panels by piano hinges on the interior sides of the panels, like the piano hinge 74.

Figure 3:
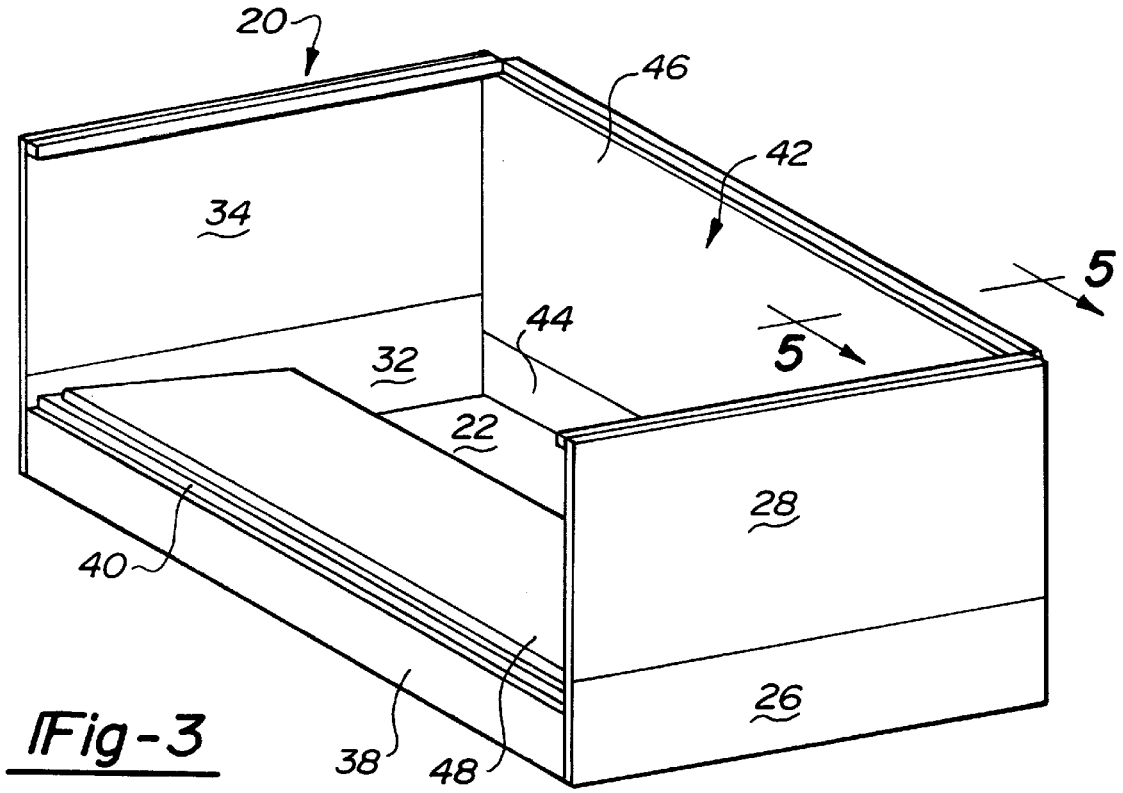
FIG. 3 is a perspective view of the wardrobe of the present invention lying on its back face and partially folded.
Figure 4:
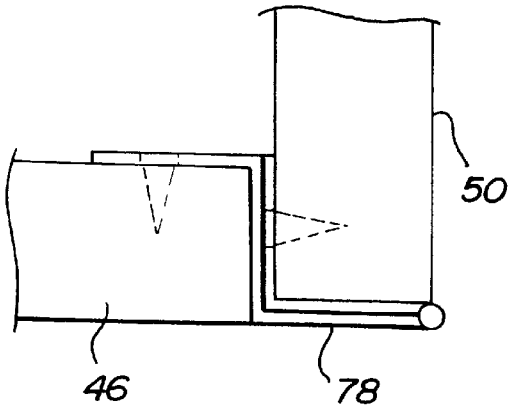
FIG. 4 is a sectional view as seen from substantially the line 4—4 in FIG. 1.
Figure 5:
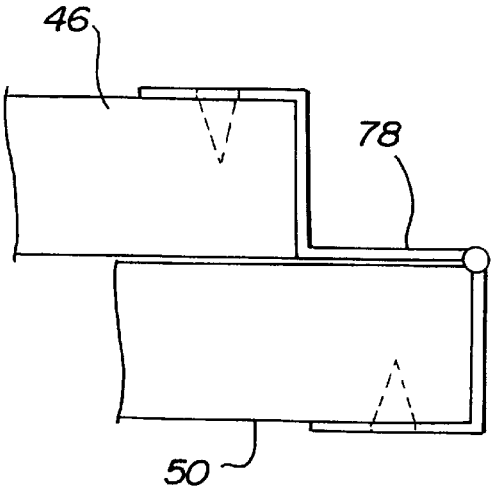
FIG. 5 is a sectional view as seen from substantially the line 5—5 in FIG. 3.
Figure 6:
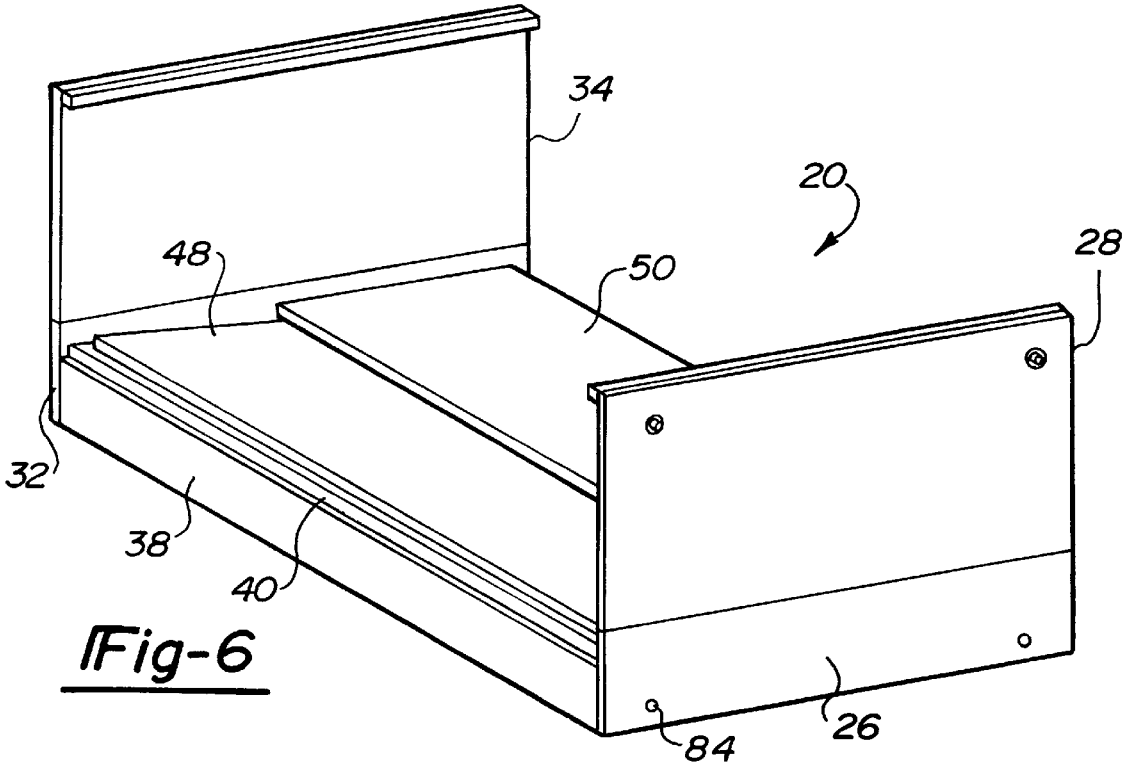
FIG. 6 is a perspective view like FIG. 3 with the wardrobe further folded to a stored position.

With reference to FIG. 3, the wardrobe 20 is shown in a partially folded position in which the front left side panel 40 has been folded about the hinge 74 to a stored position in which it overlays the back panel 22. The door 48 is shown lying upon the panel 40. The doors 48, 50 are attached to the front side panel by piano hinges 78. With reference to FIGS. 4 and 5, the relative positions of the doors and front side panels is shown. In FIG. 4, the door 50 is in an unfolded, closed position relative to the front right side panel 46. In FIG. 5, the door 50 is moved to a position in which the wardrobe is open and the door is along the exterior side of the panel 46. This is the same relative position of the door 50 and panel 46 when the panel 46 is also rotated to its stowed position as shown in FIG. 6.

Figure 7:
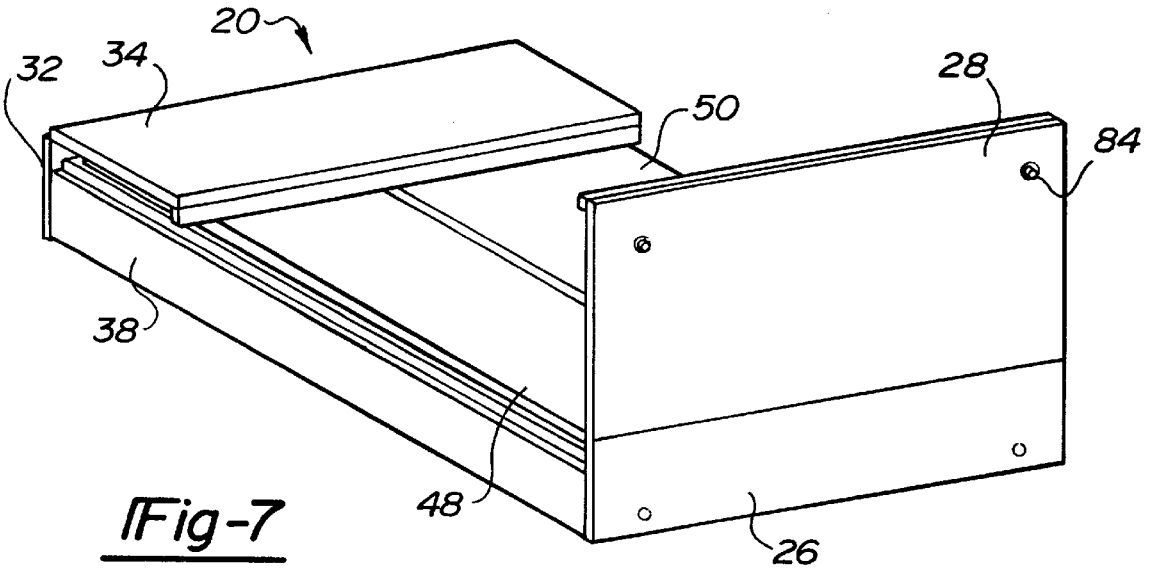
FIG. 7 is a perspective view similar to FIG. 6 with the wardrobe further folded.
Figure 8:
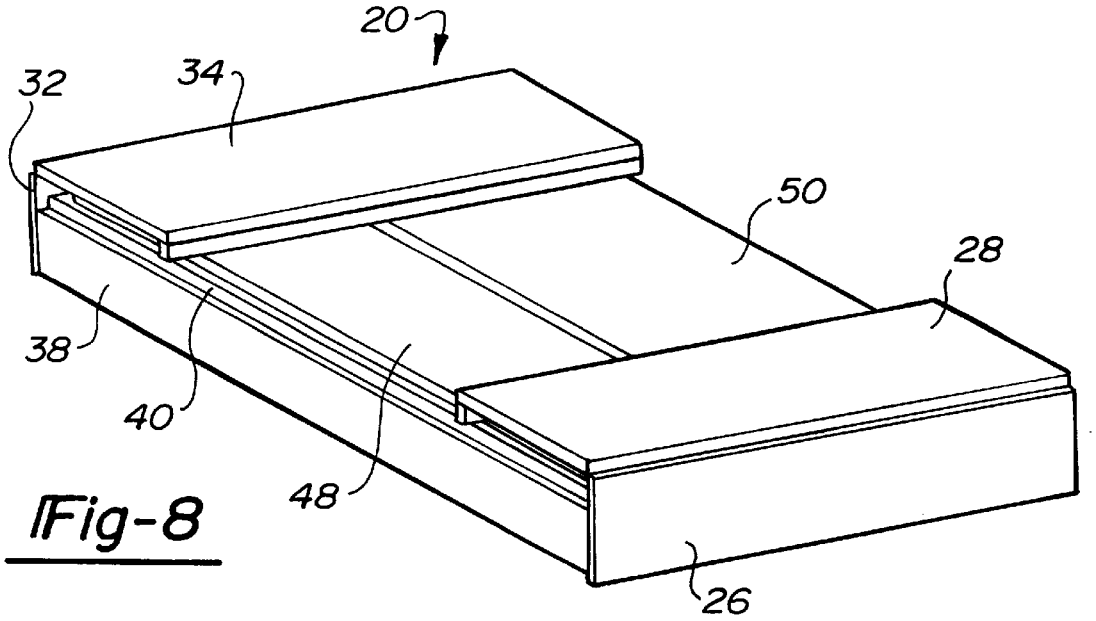
FIG. 8 is a perspective view of the wardrobe completely folded.

The rear left and right side panels 38, 44 extend forwardly from the front face of the back panel 22 such that when the front side panels 40, 46 are rotated to their stowed positions overlying the back panel 22, they are disposed forward of the back panel 22. The rear bottom panel 26 and rear top panel 32 extend further forward of the back panel 22 then do the rear side panels 38, 44 as shown in FIGS. 3, 6 and 7. This enables the front bottom panel 28 and front top panel 34 to be rotated to a stored position further forward of the back panel than the side panels 40, 46 and the doors 48, 50 as shown in FIG. 7. It will be readily appreciated that the rear side panels 38, 44 could extend further than the rear bottom and top panels if desired. The configuration shown where the rear side panels do not project as far as the rear bottom and top panels results in a more compact storage with less hollow or empty space within the wardrobe when folded.

Figure 9:
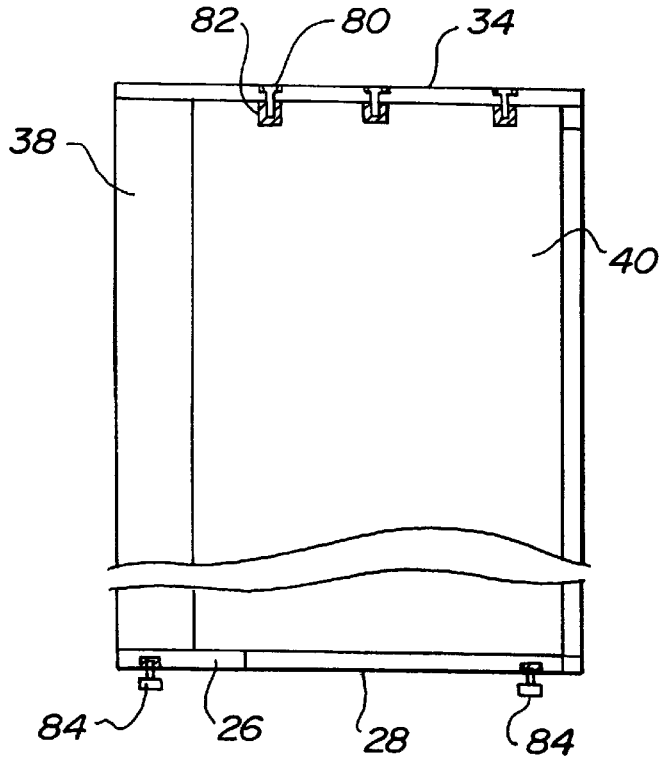
FIG. 9 is a side view of the unfolded wardrobe and partial section showing the fasteners for holding the walls in place.

When the wardrobe is unfolded, removable fasteners 80 are used to hold the front panels in place. The fasteners 80 shown in FIG. 9 are used to attach the front top panel 34 to the front left side panel 40. The fasteners are received into metal nuts 82 within the wooden frame of the side panel 40. Thus, when unfolded with the panels fastened in place, the wardrobe forms a rigid, stable structure. Leveler legs 84 are attached to the rear bottom panel 26 and front bottom panel 28. The leveler legs 84 are adjustable to level the wardrobe, once placed in the desired location.

Figure 10:
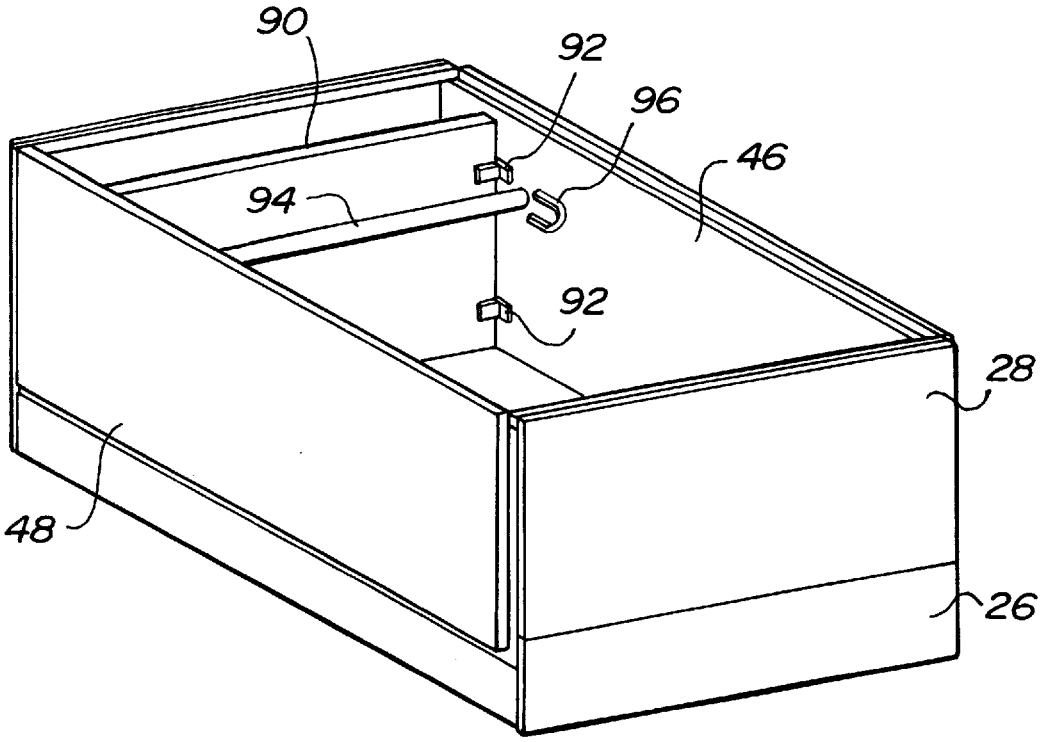
FIG. 10 is a perspective view of the unfolded wardrobe with the doors open illustrating a shelf and hanger bar.

With reference to FIG. 10, a removable shelf 90 can be installed in the wardrobe. The shelf is supported on shelf hanger brackets 92 which are attached to the side walls. The hanger brackets 92 include projecting studs that are inserted into apertures in the side walls. The front side panels include a frame cross member at the location of the hanger brackets to provide the necessary support in the front side panels for the shelf. Likewise, a hanger bar 94 can be supported on a hanger bar bracket 96 which is similarly attached to the side wall.

Figure 11:
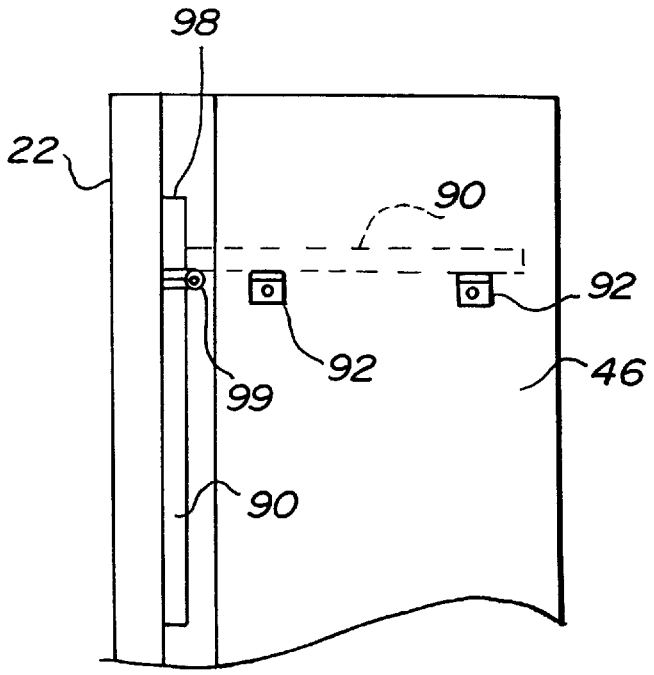
FIG. 11 is a side view of the wardrobe interior showing an alternative embodiment for the shelf.

With reference to FIG. 11, an alternative arrangement for attaching the shelf 90 is shown. The shelf 90 is attached to a mounting block 98 which is fixed to the back panel 22. The shelf 90 is attached to the mounting block 98 by a piano hinge 99. The shelf is raised to a horizontal position extending forward from the back panel 22 and supported upon shelf hangers 92.

It is to be understood that the invention is not limited to the exact construction illustrated and described above. But that various changes and modifications may be made without departing from the spirit and scope of the invention as defined in the following claims.

I claim:

1. A folding wardrobe comprising:

a back panel having front and back faces, a bottom edge, top edge and left and right side edges;

a rear bottom panel, a rear top panel, a rear left side panel and a rear right side panel each fixed to the back panel along the bottom, top, left and right side edges thereof and extending forward from said front face;

a front bottom panel, front top panel, front left side panel and front right side panel each rotatably coupled to a front edge of the rear bottom panel, rear top panel, rear left side panel and rear right side panel respectively for rotation between stowed positions overlying the back panel and use positions extending forwardly from said rear bottom panel, rear top panel, rear left side panel and rear right side panel, respectively, and extending generally planar thereto forming bottom, top and left and right side walls, wherein the rear bottom and the rear top panels each extend forward from the front face of the back panel a greater distance than the rear right and rear left side panels whereby when the front bottom panel, front top panel, front left side panel and front right side panel are in their stowed positions, the front bottom panel and the front top panel overlie the front left side panel and the front right side panel, identical left and right doors coupled to front edges of the front left and right side panels for rotation between stowed positions along an exterior face of said front left and right side panels and closed use positions extending toward one another from the front left and right side panels to close an interior space; and removable fasteners coupling the front bottom panel and the front top panel to the front left and front right side panels when the panels are in their respective use positions to prevent rotation of the front bottom, front top and front left and right side panels from the use positions, the panels thereby defining an interior space when the front bottom, front top and front left and right side panels are in the use positions, a shelf and shelf brackets attached to the rear and front left and right side panels for supporting the shelf, said front left and right side panels are constructed of wood frames about the peripheries thereof with a lightweight filler therein and a decorative cover thereon and the wood frame includes a cross member to which said shelf brackets are attached.

* * * * *